US006397812B1

(12) United States Patent
Ernst

(10) Patent No.: US 6,397,812 B1
(45) Date of Patent: Jun. 4, 2002

(54) TEMPORARY CYLINDER AND PISTON ROD HOUSING FOR AN ENGINE BEING REPAIRED

(76) Inventor: Gregory R. Ernst, 15735 SE. Bartell Rd., Boring, OR (US) 97009

( * ) Notice: Subject to any disclaimer, the term of this patent is extended or adjusted under 35 U.S.C. 154(b) by 0 days.

(21) Appl. No.: 09/803,557

(22) Filed: Mar. 12, 2001

(51) Int. Cl.[7] ..... F02B 72/00
(52) U.S. Cl. ..... 123/198 R
(58) Field of Search ..... 123/1 R, 198 R; 220/DIG. 13, 671

(56) References Cited

U.S. PATENT DOCUMENTS 4,530,141 A * 7/1985 Vachon ..... 19/156

* cited by examiner

*Primary Examiner*—Tony M. Argenbright
*Assistant Examiner*—Katrina B. Harris
(74) *Attorney, Agent, or Firm*—James D. Givnan, Jr.

(57) ABSTRACT

A housing includes a flange apertured to receive cap screws for temporary attachment to the block of an air cooled engine to enclose a piston rod and close a cylinder of the engine to protect engine parts from foreign matter. Oval flange openings accept cap screws for a range of cap screw patterns found in different engines.

4 Claims, 1 Drawing Sheet

TEMPORARY CYLINDER AND PISTON ROD HOUSING FOR AN ENGINE BEING REPAIRED

BACKGROUND OF THE INVENTION

The present invention concerns engines being overhauled or repaired incurring the removal of one or more cylinder heads.

When working on air cooled engines it is frequently necessary to remove one or all cylinder heads from the engine block leaving the interior of the engine and piston rod exposed to moisture and airborne matter. It is a practice in some repair shops to close the cylinder or cylinders of an engine being repaired by the stuffing of a clean rag into the cylinder with a portion of the rag or a separate rag applied about the exposed end of a piston rod. Such a solution to the problem is a hit and miss approach to protecting internal parts of the engine as well as the rod end from foreign matter being deposited on engine and rod surfaces. Further, some risk of damage to an engine being repaired occurs when a piston rod end protrudes from the engine block.

SUMMARY OF THE PRESENT INVENTION

The present invention concerns a housing temporarily attachable to th block of an air cooled engine and serves to close the cylinder opening of the engine as well as enclose and support the outer end segment of a piston rod from which a piston has been removed.

The housing is adapted for temporary attachment to the engine block without alteration or modification of the block with a housing flange in surface abutment with the block wall to provide a seal against foreign matter. The housing may confine that portion of a piston rod normally housed by a cylinder now removed during engine maintenance or repair. The piston rod is free to move back and forth within the present housing during engine crank shaft rotation coincident with repair efforts. A portion of the housing serves as a guide for the rod end which may be fitted with the wrist pin or preferably a substitute wrist pin. A housing mounted flange has a series of springs for cap screws with some of the openings oblong to accommodate a range of air cooled engines with blocks having different bolt patterns.

Important objectives of the present invention include the provision of a housing readily attachable and detachable from an engine block to close the cylinder bore of the block against entry of foreign matter; the provision of a housing of a length to permit reciprocation of a piston rod during cranking of an engine during engine repair while protecting the piston rod from foreign matter; the provision of a housing having a face plate or flange abuttable with the engine block and defining fastener receiving openings, some of which are of other than circular shape to permit utilizing of the present housing on engine blocks having different bolt receiving patterns.

DETAILED DESCRIPTION OF THE PREFERRED EMBODIMENTS

Figures 1, 2, 2A, 3, 4, 5:
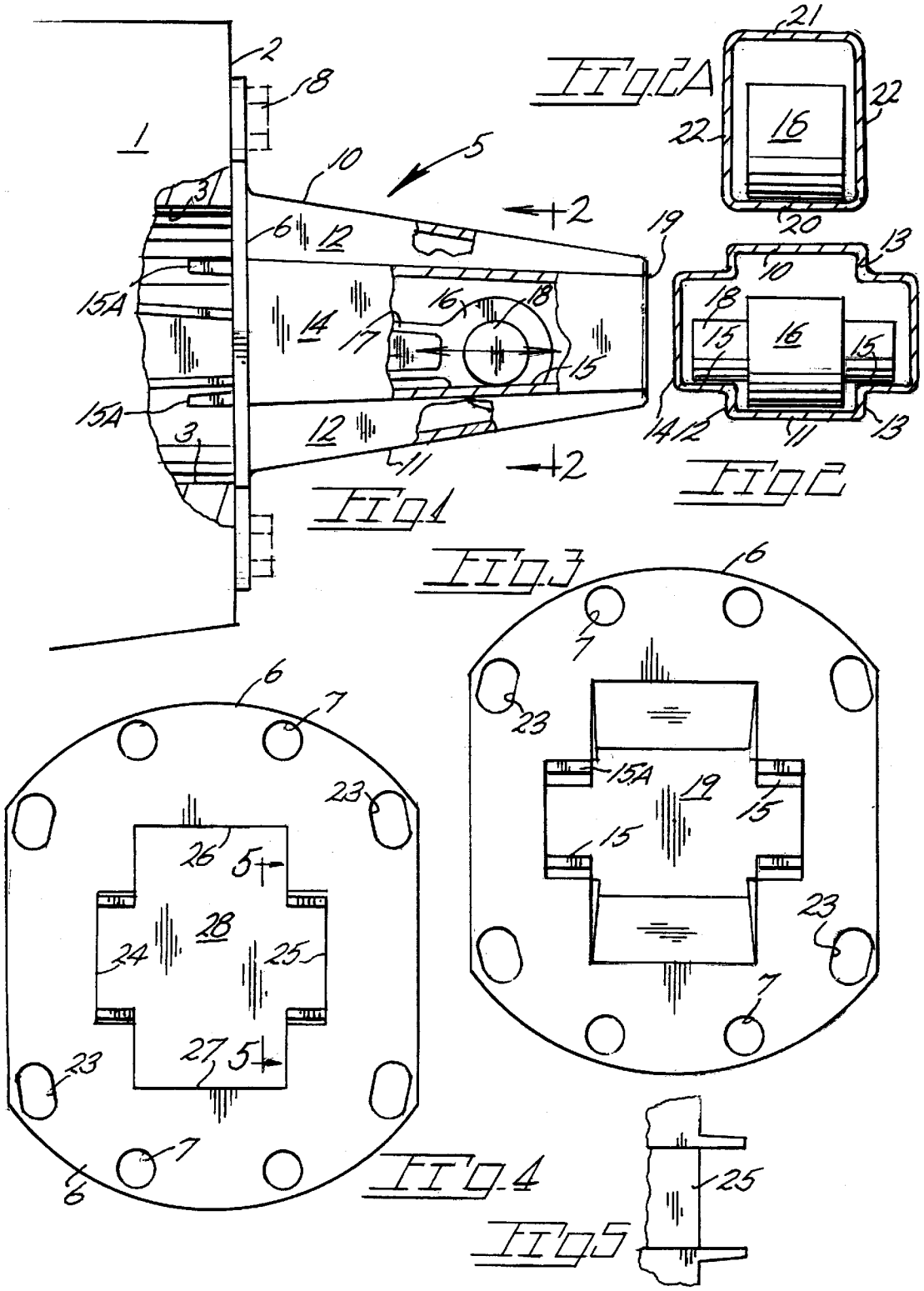
FIG. 1 is a side elevational view of the present invention in place on an engine block shown in schematic form.
FIG. 2 is a vertical sectional view taken along line 2—2 of FIG. 1.
FIG. 2A is a view similar to FIG. 2 showing a modified housing.
FIG. 3 is an end view of the present housing of FIG. 1 removed from an engine block.
FIG. 4 is a view similar to FIG. 3 but showing a modified form of the housing having orthogonal wall surfaces.
FIG. 5 is a fragmentary elevational view taken along line 5—5 of FIG. 4.

With continuing attention to the drawings wherein applied reference numerals indicate parts similarly hereinafter identified, the reference numeral 1 indicates the block of an air cooled engine having a block wall surface 2 from which a cylinder head has been removed upon removal of cap screws.

A block defined bore or cylinder 3 in which, during engine operation a piston rod recirates. Engine block 1 additionally defines multiple threaded bores which receive a series of cap screws attaching a cylinder head flange to the block.

Depending on the extent of engine maintenance being performed, one or all of the cylinder heads will be removed leaving block surface 2 suitable for attachment of the present housing indicated generally at 5. A housing flange 6 extends about the housing end and defines openings at 7 which correspond with openings or threaded bores in engine block 1. Cap screws are at 8.

In a preferred form of the invention, the housing includes walls 10 and 11, with side walls at 12 and 13. Guide means is provided by a pair of channels at 14 each having a shoulder 15 on which a pin 18 may rest or slide to support the end 16 of a piston rod 17. The pin 18 may be a rod wrist pin or a simulated temporary wrist pin provided for sliding engagement with shoulders 15.

Shoulder extensions at 15A extend into the cylinder for rod end support. An end wall at 19 closes the housing.

A modified form of the housing side walls is shown in FIG. 2A dispenses with channels 14 and permits rod end 16 to ride on a wall 20. Walls 20 and 21 of the modified form of the invention would preferably be inclined in the manner of walls 10 and 11 in the earlier described form of the invention. Side walls are at 22.

With reference to FIG. 3, flange 6 includes the aforementioned openings 7 for reception of cap screws 8 with some of the openings being oblong as at 23 to accommodate two somewhat different bolt patterns existing in two different makes or models of air cooled aircraft engines.

With reference to FIG. 4, a modified housing is shown wherein housing walls at 24, 25, 26 and 27 are orthogonal with respect to flange 16, an end wall is at 28.

While I have shown but a few embodiments of the invention, it will be apparent to those skilled in the art that the invention may be embodied still otherwise without departing from the spirit and scope of the claimed invention.

Having thus described the invention, what is desired to be secured by a Letters Patent is:

1. A temporary housing for installation on an air cooled engine block being repaired to protect a piston rod and the engine interior from foreign matter upon removal of an engine cylinder head, said housing comprising a base for temporary abutment with a surface of the engine block upon cylinder head removal, guide means for slidably supporting one end of a piston rod and permitting travel of the piston rod during cranking of the engine for engine repair purposes.

2. The temporary housing claimed in claim 1 wherein said base includes a mounting flange defining multiple openings, fasteners insertable in said openings and engageable with the flange and the engine block.

3. The temporary housing claimed in claim 1 wherein said guide means defines a channel.

4. The temporary housing claimed in claim 3 additionally including a pin carried by the piston rod for travel in said channel.

* * * * *